United States Patent [19]

Mengeu

[11] Patent Number: 5,065,908

[45] Date of Patent: Nov. 19, 1991

[54] DISPENSING FITMENT AND CONTAINER THEREFORE

[75] Inventor: Gary L. Mengeu, Wheeling, W. Va.

[73] Assignee: Continental Plastics, Inc., Triadelphia, W. Va.

[21] Appl. No.: 642,028

[22] Filed: Jan. 16, 1991

[51] Int. Cl.[5] ..... B65D 3/00; B67D 47/06

[52] U.S. Cl. ..... 222/480; 215/31; 215/355; 222/563; 222/566

[58] Field of Search ..... 222/480, 569, 570, 562, 222/563, 564, 565, 547; 215/31, 100 R, 307, 355, 354, 347, 362, 364, 300

[56] References Cited

U.S. PATENT DOCUMENTS

| | | | |
|---|---|---|---|
| 232,211 | 9/1880 | Schilling | 222/563 |
| 927,771 | 7/1909 | Bodman | 215/358 |
| 1,316,723 | 9/1919 | Kammer . | |
| 2,889,967 | 6/1957 | Drennan | 222/498 |
| 2,921,724 | 1/1960 | Whitney | 222/562 |
| 3,015,403 | 1/1962 | Fuller | 215/13 |
| 3,151,787 | 10/1964 | Miller | 222/518 |
| 3,253,753 | 5/1966 | Barton et al. | 222/547 |
| 4,427,138 | 1/1984 | Heinlein | 222/569 X |

FOREIGN PATENT DOCUMENTS

| | | | |
|---|---|---|---|
| 1011307 | 6/1957 | Fed. Rep. of Germany | 215/354 |
| 1120713 | 7/1956 | France | 215/358 |
| 651725 | 1/1963 | Italy | 215/355 |
| 558998 | 1/1944 | United Kingdom | 222/562 |

*Primary Examiner*—Donald T. Hajec

*Attorney, Agent, or Firm*—Richard V. Westerhoff

[57] ABSTRACT

A dispensing fitment has a perforated end wall with a peripheral edge which wedges against a tapered portion of a container opening, and a cylindrical skirt terminating in tabs which extend through a minimum diameter of the container opening and flare radially outward to engage the opening below the minimum diameter.

14 Claims, 2 Drawing Sheets

DISPENSING FITMENT AND CONTAINER THEREFORE

BACKGROUND OF INVENTION

1. Field of Invention

This invention relates to a fitment which seats in the neck of a container and has openings through which the contents of the container can be dispensed.

2. Background Information

Containers for granular or powered products such as for example, spices, and for liquids such as salad dressing, vinegar, et cetera, are often provided with fitments seated in the neck of the container. The fitment has one or more apertures through which the product can be dispensed such as by sifting or shaking. Examples of such fitments are disclosed in U.S. Pat. Nos. 2,889,967 and 2,921,724. Such fitments typically have an end wall with a flange which seats on the rim of the container neck and a cylindrical skirt which extends into the container neck and expands radially outward to engage the inner surface of the neck where it flares outward into the container. For some products, it is desirable to provide a vacuum seal which seats on the container rim. Fitments having a flange which seats on the container rim interfere with such a vacuum seal.

The prior art fitments have either a continuous annular skirt or a skirt with very narrow axial slots dividing the skirt into tabs which subtend large circumferential angles. These configurations make the skirts very stiff. This requires close tolerances to assure a tight fit of the fitment in the container opening.

There are particular difficulties with the above described dispensing fitments for use with glass containers. It is very difficult to maintain tolerances on glass containers, and hence, most attention is directed to holding tolerances on the outer dimensions of the neck including the threads or bead for securing a container closure, and little attention is paid to the inner dimension except to set a minimum opening. Any dispensing fitment for glass containers must, therefore, have enough flexibility to accommodate for sizeable variations in dimensions of the opening while providing a tight fit and resistance to being sucked into a vacuum packed container.

It is an object of the invention to provide a container and dispensing fitment therefor which do not require tight manufacturing tolerances to assure that the fitment firmly seats in the container opening.

It is also an object of the invention provide such a container and dispensing fitment therefor which can be used with a vacuum seal which seats on the container rim.

SUMMARY OF THE INVENTION

These and other objects are realized by the invention which is directed to a fitment, and the fitment in combination with a container having a neck terminating in a rim and with an opening which tapers radially inward from a maximum diameter at the rim to a minimum diameter at an inflection point and which then flares radially outward. The fitment includes an end wall with a peripheral edge which has a diameter between the maximum and minimum diameters of the tapered portion of the container opening. A cylindrical skirt spaced radially inward from the peripheral edge extends axially from the end wall and has a terminal portion which flares radially outward, also to an outer diameter between the maximum and minimum diameters of the tapered portion of the container opening. The fitment seats in the container opening with the peripheral edge of the end wall wedged against the tapered portion of the opening, with the skirt extending through the inflection point and with the terminal portion flaring radially outward into contact with the flared portion of the container opening. The terminal portion of the cylindrical skirt constitutes tabs defined by circumferentially spaced slots extending axially from the free edge of the skirt. Preferably, the fitment skirt has an outer diameter greater than the minimum diameter of the container opening and the slots which define the tabs extend axially a distance into the skirt such that with the fitment seated in the container opening, the bottoms of the slots are between the point at which the skirt contacts the tapered portion of the opening and the inflection point. This configuration provides maximum flexibility to the tabs which secure the fitment in the container opening while maintaining a seal between the fitment skirt and the container opening. As the fitment does not engage the rim of the container, the closure can include a lid for vacuum sealing which seats on the rim.

In an alternate embodiment of the invention, the tapered portion of the container opening is provided with an annular shoulder and the peripheral edge of the fitment end wall has a radially extending annular rib which either seats on the radial shoulder or engages the tapered portion of the container opening below the shoulder. This embodiment of the invention can accommodate even greater variations in the tolerance of the container opening dimensions.

DESCRIPTION OF THE PREFERRED EMBODIMENTS

Figures 1, 2:
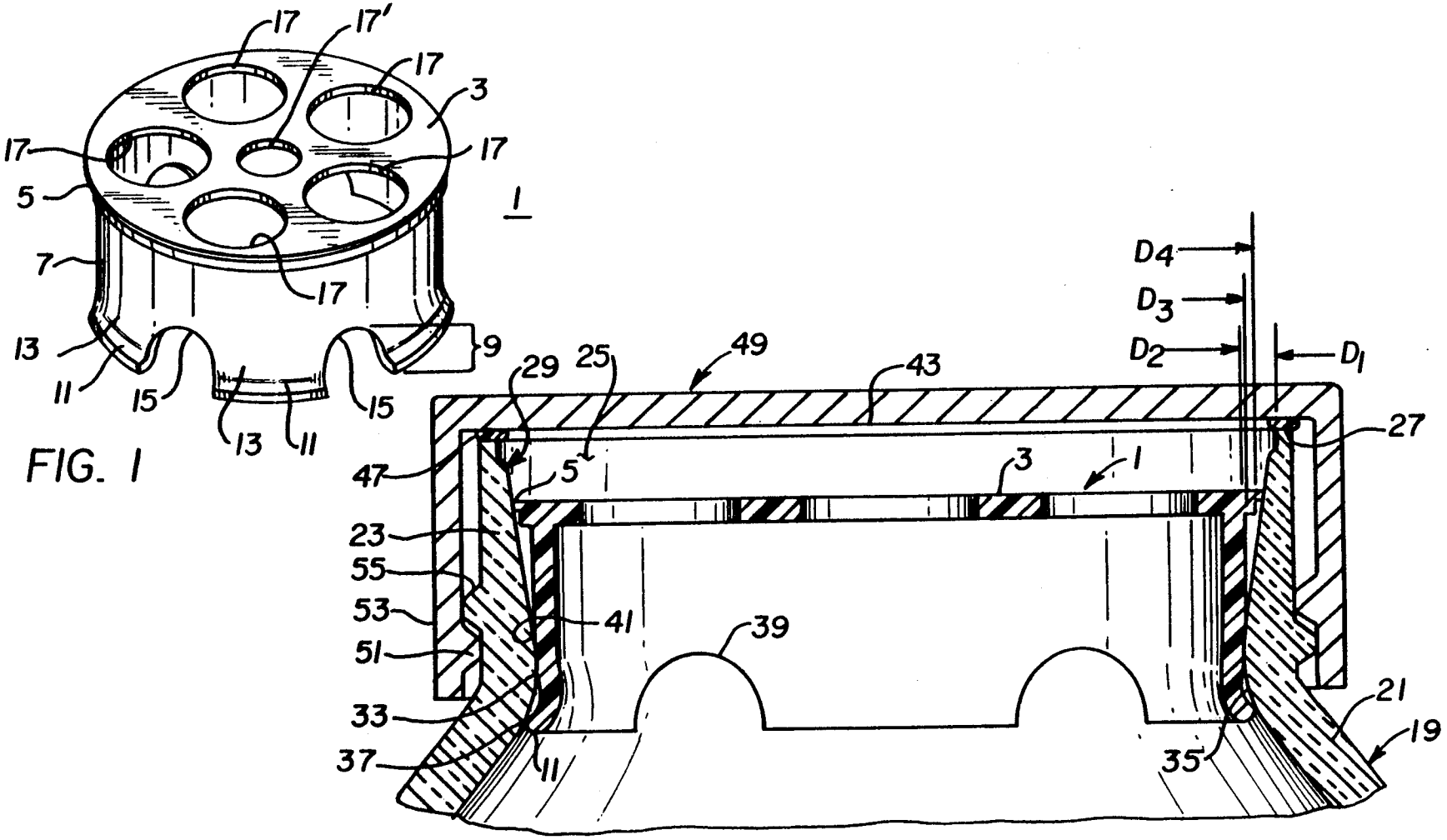
FIG. 1 is an isometric view of a fitment in accordance with the invention.
FIG. 2 is a vertical sectional view through a container and closure with the fitment of FIG. 1 seated in the container opening.

The invention will be described as applied to a sifter fitment for dispensing granular material such as spices from a container. It will become apparent to those skilled in the art that the invention has application to fitments and containers for dispensing other types of products including liquids.

The fitment 1 includes a circular end wall 3 with a peripheral edge 5. A cylindrical skirt 7 spaced radially inward from the peripheral edge 3 extends axially from the end wall 3 and terminates in a terminal portion 9 which flares outward to form an annular bead 11. The terminal portion 9 includes tabs 13 formed by scalloped axially extending slots 15.

A plurality of dispensing apertures 17 are provided in the end wall 3. In the exemplary fitment 1, there are five equiangularly spaced apertures centered around the smaller center opening 17'. The number and size of the openings are determined by the product to be dispensed and the desired rate of dispensing. For liquids, for instance, a single circular or slot type opening could be substituted for the large circular openings shown in FIG. 1.

The fitment 1 is integrally molded from a resilient resin material so that the tabs 13 are resiliently deflectable in a manner to be discussed. A preferred material is high density polyethylene. Other suitable resin materials for the fitment 1 include: polypropylene, low density polyethylene, and for use with oily products, linear low density polyethylene.

The fitment 1 is used with a container 19 having a body 21 and a neck 23 having a rim 27 at a free end which defines a container opening 25. The opening 25 defined by the inner wall 29 of the container neck 23 has a first section 31 extending inward from the rim which tapers from a maximum diameter $D_1$ adjacent the rim 27 to a minimum diameter $D_2$ at an inflection point 33. A second section 35 of the opening 25 flares radially outward from the inflection point 33 toward the container body 21. The peripheral edge 5 of the end wall 3 of the fitment 1 has a diameter $D_3$ which is less than the maximum diameter $D_1$ but greater than the minimum diameter $D_2$ of the first section 33 of the opening 25. The cylindrical skirt 7 has an outer diameter $D_4$ which is also between the maximum and minimum diameters $D_1$ and $D_2$, but is smaller than the diameter $D_3$. The outer diameter of the annular bead 11 on the tabs 13 is substantially greater than the minimum diameter $D_2$, but is also smaller than the maximum diameter $D_1$. The exemplary container 19 is made of glass so that the dimensions such as the diameters $D_1$ and $D_2$ are not precise. However, the difference between the diameters $D_1$ and $D_2$ are large enough that even with fairly lose tolerances, the relationships discussed above between the diameters of the container and of the fitment remain valid.

In applying the fitment 1 to the container 19, the annular bead 11 contacts the tapered first section 31 of the opening 25 in the container neck 23. As the fitment is pressed into the opening, the tabs 13 formed by the scalloped slots 15 deflect inward until the bead 11 passes the inflection point 33 and the tabs 13 then spring radially outward to seat the fitment 1 in the container opening with the peripheral edge 5 of the end wall 3 wedged against the tapered first section 31 and with the bead 11 making a point contact along the line 37 on the second flared section 35 of the container opening. The peripheral edge 5 on the end wall bearing against the tapered section 31 of the container opening prevents the fitment from being pushed into the container during the packaging operation, while the bead 11 contacting the flared section 35 prevents the fitment from being pulled out of the opening during the vacuum process and when the container is turned over and shaken. The scalloped slots 15 have a height which is such that with the fitment seated in the container opening, the peaks 39 of the slots 15 lie between the inflection point 33 and the line of contact 41 between the skirt 7 of the fitment and the tapered first section 31 of the container opening. Thus, the slots 15 have a height which gives flexibility to the tabs 13, but do not extend far enough into the cylindrical skirt to allow material to escape therethrough into the space between the cylindrical skirt 5 and the tapered section 31 adjacent the end wall. It has been found that scalloping of the slots 15 provide a desired combination of flexibility and stiffness of the tabs 13 to firmly secure the fitment in the container opening with reasonable insertion and removal forces. It has been found that best results are achieved where the material of the tabs 13 comprises 50% to 75% of the terminal portion 9 of the cylindrical skirt 5 and with the slots forming 50% to 25% of the this terminal portion. In the exemplary embodiment, the tabs 13 constitute 60% of the terminal portion of the skirt and the slots 15 constitute the remaining 40%.

The container 19 is typically filled with product and after the fitment 1 is inserted in the opening, a metal lug cap 49 having a seal 47 is seated on the container rim 27 and secured in place with an internal thread 51 on a cylindrical skirt 53 which engages an external thread 55 on the container neck 23. As can be seen, with the end wall 3 of the fitment 1 seated in the tapered section 31 of the container opening, the fitment 1 does not interfere with the vacuum sealing of the container by the cap 49.

Figure 3:
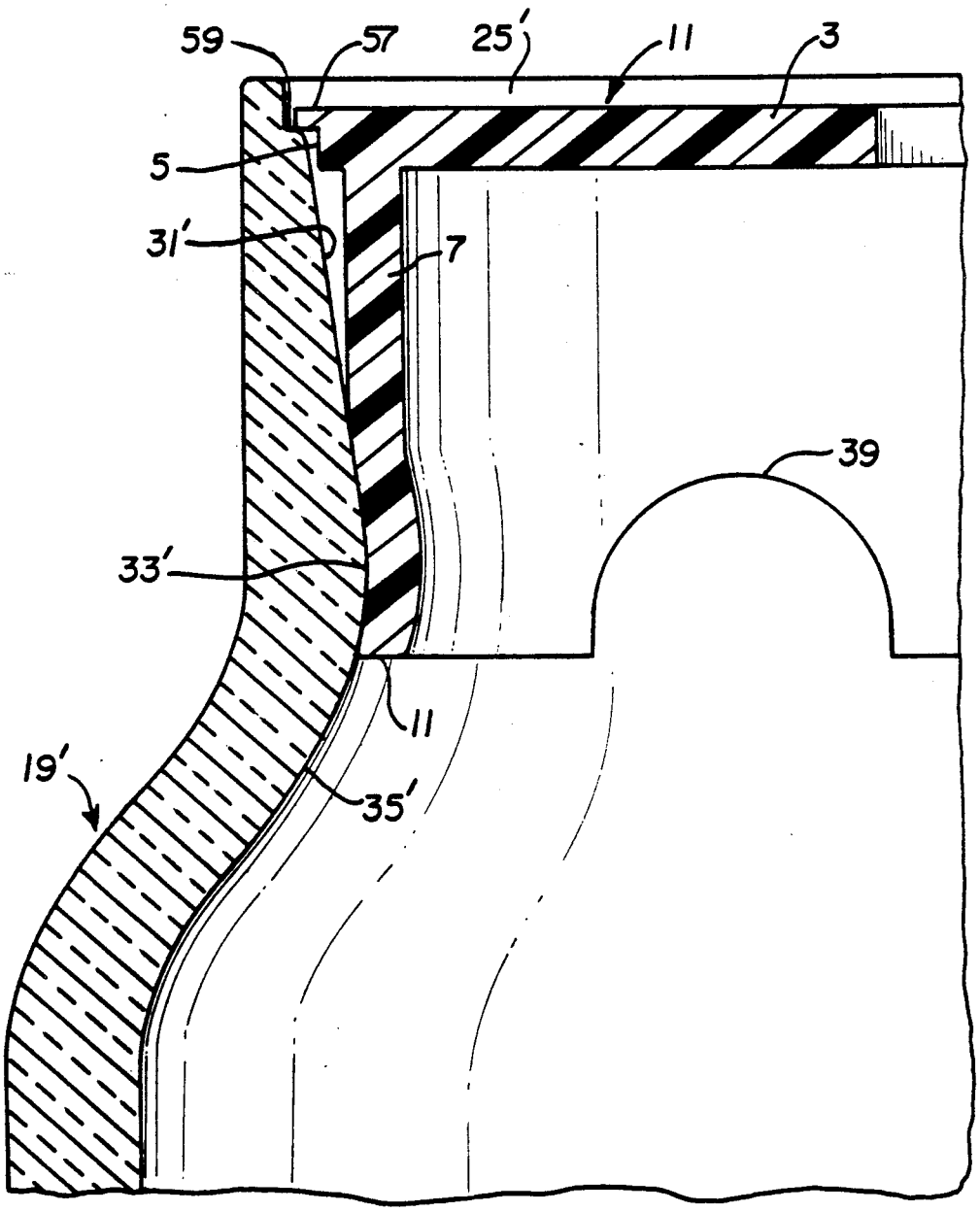
FIG. 3 is a fragmentary view in enlarged scale of a portion of FIG. 2 illustrating another embodiment of the invention.

In an alternate embodiment of the invention shown in the enlarged fragmentary view of FIG. 3, a radially outwardly extending annular rib 57 is provided on the peripheral edge 5 of the end wall of the fitment 1'. This fitment 1' can be used with a container 19' in which a radial shoulder 59 is provided on the tapered first section 31' of the opening 25'. In this embodiment, the rib 57 can seat on the shoulder 59, or if the tolerances are such, the rib could seat on the tapered section 31' below the shoulder 59. This configuration of the fitment and the container opening allow accommodation for greater variations in the tolerances of the container opening.

The fitment in accordance with the invention and the combination of the fitment with the container with the tapered opening provide a dispensing fitment for containers, especially glass containers, with wide variations in the dimensions of the container opening. Despite these wide variations in container opening dimensions, the fitment is flexible enough to firmly seat in the openings of all containers which are within tolerance.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A fitment for a container having a body portion and a neck on said body portion terminating in a rim and defining a generally cylindrical opening having a tapered portion which tapers from a maximum diameter at said rim to a minimum diameter at an inflection point, and a flared portion which flares outward in diameter towards said body portion from the minimum diameter at said inflection point, said fitment comprising:

a circular end wall with at least one dispensing opening therein, and having a peripheral edge with a diameter which is between said maximum and minimum diameters of said opening; and a cylindrical skirt extending axially from and spaced radially inward from said peripheral edge of said end wall, and terminating in a terminal portion which flares radially outward to a diameter greater than said minimum diameter at a free edge;

said fitment seating in said cylindrical opening in the container neck with said peripheral edge on said end wall wedged against the tapered portion of said opening at a point spaced from said rim of said neck, with said cylindrical skirt extending through the inflection point in said opening, and with said terminal portion of said skirt flared radially outward into engagement with said flared portion of said opening.

2. The fitment of claim 1 wherein said terminal portion of said skirt constitutes tabs defined by circumferentially spaced slots extending axially from said free edge of the terminal portion of said skirt.

3. The fitment of claim 2 wherein said tabs are provided at said free edge with a peripheral bead which makes line contact with said flared portion of said container opening.

4. The fitment of claim 3 wherein said slots extend axially from said free edge of said terminal portion of the skirt to at least said inflection point of said container opening with said fitment seated in the container opening.

5. The fitment of claim 4 wherein said slots are scalloped.

6. The fitment of claim 1 wherein said outside diameter of said skirt is greater than said minimum diameter, wherein said terminal portion constitutes tabs defined by circumferentially spaced slots extending axially from said free edge of the terminal portion of said skirt and wherein the free edge of said terminal portion defined by said tabs is provided with a circumferentially extending bead which makes line contact with the flared portion of said container opening.

7. The fitment of claim 6 wherein with said fitment seated in said container opening said slots extend axially from the free edge of the terminal portion of said skirt to a point between a point at which said skirt contacts the tapered portion of said container opening and said inflection point.

8. The fitment of claim 7 wherein said slots are scalloped.

9. The fitment of claim 8 wherein said tabs constitute between about 50% to 75% and said slots constitute about 50% to 25% of said terminal portion of said skirt.

10. The fitment of claim 9 wherein said tabs constitute about 60% and said slots constitute about 40% of said terminal portion of said skirt.

11. In combination:

a container having a body portion and a neck on said body portion terminating in a rim and defining a generally cylindrical opening having a tapered portion which tapers from a maximum diameter at said rim to a minimum diameter at an inflection point, and a flared portion which flares outward in diameter toward said body portion from the minimum diameter at said inflection point;

a fitment comprising a circular end wall with at least one dispensing opening therein and having a peripheral edge with a diameter which is between said maximum and minimum diameters of said opening; and a cylindrical skirt extending axially from and spaced radially inward from said peripheral edge of said end wall, and terminating in a terminal portion which flares radially outward at a free edge to form a bead having a diameter greater than said minimum diameter, said fitment seating in said cylindrical opening in the container neck with said peripheral edge on said end wall wedged against the tapered portion of said opening at a point spaced from said rim, with said cylindrical skirt extending through the inflection point in said opening and with said annular bead of said skirt flared radially outward into engagement with said flared portion of said opening; and closure means engaging said neck of said container and closing said opening, said closure means including means which seats on said rim of said neck.

12. The combination of claim 11 wherein said skirt of said fitment has an outer diameter which is greater than said minimum diameter of said opening at said inflection point, and wherein said terminal portion of the skirt of said fitment comprises tabs defined by slots which with said fitment seated in said container opening extend axially from the free edge of said skirt to a point opening between a point at which the skirt of said fitment contacts the tapered portion of said container opening and said inflection point.

13. The combination of claim 12 wherein said tapered portion of the container opening has an annular shoulder spaced from said rim upon which said peripheral edge of said end wall of said fitment can seat.

14. The combination of claim 13 wherein said peripheral edge of said end wall of the fitment has an annular radially outwardly extending rib which can seat on said annular shoulder and the tapered portion of said container opening.

* * * * *